US008381925B2

(12) United States Patent
Skillin et al.

(10) Patent No.: US 8,381,925 B2
(45) Date of Patent: Feb. 26, 2013

(54) CONTAINER HAVING A TAMPER EVIDENT DISPENSING CLOSURE AND LABEL SYSTEM WITH IMPROVED LABEL

(75) Inventors: Clifford W. Skillin, Blackstone, MA (US); Richard A. Tarozzi, Gales Ferry, CT (US)

(73) Assignee: MWV Slatersville, LLC, Slatersville, RI (US)

( * ) Notice: Subject to any disclaimer, the term of this patent is extended or adjusted under 35 U.S.C. 154(b) by 1185 days.

(21) Appl. No.: 11/734,703

(22) Filed: Apr. 12, 2007

(65) Prior Publication Data

US 2007/0241075 A1 Oct. 18, 2007

Related U.S. Application Data

(60) Provisional application No. 60/744,902, filed on Apr. 14, 2006, provisional application No. 60/803,144, filed on May 25, 2006.

(51) Int. Cl.

| | |
|---|---|
| ***B65D 39/00*** | (2006.01) |
| ***B65D 47/00*** | (2006.01) |
| ***B67B 5/00*** | (2006.01) |
| *B65D 85/00* | (2006.01) |

(52) U.S. Cl. ..... 215/253; 215/235; 215/237; 215/230; 206/459.5; 222/556; 222/153.06

(58) Field of Classification Search ..... 215/253, 215/230, 235, 237, 258, 321; 222/153.14, 222/153.06, 556, 541.6, 541.5; 220/268, 220/837, 839; 40/310, 311; 206/159.1, 459.5, 206/459.1

See application file for complete search history.

(56) References Cited

U.S. PATENT DOCUMENTS

| | | | | |
|---|---|---|---|---|
| 3,088,830 | A | 5/1963 | Graham | |
| 4,540,101 | A | 9/1985 | Kutcher | |
| 4,640,427 | A | 2/1987 | Marino et al. | |
| 4,998,988 | A | 3/1991 | Zinnbauer | |
| 5,012,940 | A | 5/1991 | Koehn | |
| 5,437,383 | A * | 8/1995 | Stull | 215/235 |
| 5,495,944 | A | 3/1996 | Lermer | |
| 5,586,087 | A * | 12/1996 | Silverson | 368/10 |
| 5,722,547 | A | 3/1998 | Shankland | |
| 5,875,907 | A | 3/1999 | Lay | |
| 5,875,908 | A | 3/1999 | Witt et al. | |
| 5,967,384 | A * | 10/1999 | Mengeu et al. | 222/517 |
| 5,996,849 | A | 12/1999 | Bansal | |
| 6,116,441 | A | 9/2000 | Decelles et al. | |
| 6,405,885 | B1 | 6/2002 | Elliott | |
| 6,460,712 | B2 | 10/2002 | Smith et al. | |
| D469,471 | S | 1/2003 | Chaduc et al. | |
| 6,550,626 | B1 | 4/2003 | Randall | |
| 6,908,113 | B2 | 6/2005 | Chaduc et al. | |

(Continued)

FOREIGN PATENT DOCUMENTS

| | | | |
|---|---|---|---|
| JP | 2000142761 | A | 5/2000 |
| JP | 2001315824 | A | 11/2001 |

*Primary Examiner* — Robin Hylton

(74) *Attorney, Agent, or Firm* — Barlow, Josephs & Holmes, Ltd.

(57) ABSTRACT

A dispensing closure and label system provides a clear indication of prior opening directly at the point of application of force to open the closure. The dispensing closure includes a closure body, a living hinge and a lid. The lid includes a downwardly depending sidewall that has a thumb tab that extends down beyond the parting line of the lid and the closure body. A label wraps around the skirt and container neck. The label overlaps that portion of the thumb tab that extends below the parting line of the lid and body. When the thumb tub is lifted to open the container, the paper label is ripped in the area of the thumb tab to evidence opening.

5 Claims, 14 Drawing Sheets

U.S. PATENT DOCUMENTS

2003/0047937 A1 3/2003 Chaduc et al.
2004/0150221 A1 8/2004 Brown
2005/0039416 A1 2/2005 Hidding
2006/0011573 A1 1/2006 Herald et al.

* cited by examiner

CONTAINER HAVING A TAMPER EVIDENT DISPENSING CLOSURE AND LABEL SYSTEM WITH IMPROVED LABEL

CROSS REFERENCE TO RELATED APPLICATIONS

This application is related to and claims priority from earlier filed provisional patent application Ser. No. 60/744,902, filed Apr. 14, 2006 and provisional patent application Ser. No. 60/803,144, filed May 25, 2006, which are both incorporated herein by reference.

BACKGROUND OF THE INVENTION

The present invention generally relates to a tamper evident dispensing closure and label system, and more particularly to a novel construction of the closure lid and label that provides visible evidence of prior opening of the product without entirely destroying the label.

Many tamper indicating closure and container assemblies of the prior art typically rely on destruction of a part of the assembly, to indicate prior opening. For example, some arrangements in the prior art utilize a tear band, such as a paper seal, around the rim of a jar or container. For example, the U.S. Pat. No. 3,088,830 to Graham, discloses a tamper resistant closure wherein a paper band is glued around the entire periphery of the neck of the container and the skirt of a twist-on threaded closure. A line of weakness is provided at the junction between the skirt and the container neck to facilitate breaking of the seal upon twisting of the closure cap during removal thereof. The resulting tear line in the paper band clearly evidences prior opening of the container. Other tamper indicating arrangements require separation of parts such as a tamper indicating ring attached to the skirt of a closure by a line of weakening or webs which break upon removal of the closure for the first time leaving the broken and separated ring to indicate tampering. Such arrangements require careful design and manufacture to insure that opening can be accomplished with a uniform and low opening force. For example, the U.S. Pat. No. 5,722,547 to Shankland, discloses a tamper indicating closure system wherein prior opening of the container is indicated by exposing projections formed integrally with the closure. The projections remain concealed in the originally closed condition, but are exposed upon rotation of the closure with respect to the container spout or opening. While there are many such systems currently available, there is still a continuing need for new and novel tamper indicating systems for dispensing containers.

BRIEF SUMMARY OF THE INVENTION

The present invention provides a dispensing closure and label system that provides a clear indication of prior opening directly at the point of application of force to open the closure. More specifically, the system includes a dispensing closure containing a body, a lid and an integrally formed living hinge that joins the lid to the body.

The body of the closure includes an upper deck having a central dispensing orifice, and further includes a downwardly depending skirt with internal threads that are configured and arranged to engage with external threads on the neck of a container. The skirt of the closure and the neck of the container are configured to have a substantially similar outer dimension. For purposes of this preferred embodiment, the design is operable with a closure and bottleneck having no required orientation and will work at any position 360 degrees around the bottleneck.

The lid includes a top wall and a downwardly depending sidewall. Opposite to the hinge, the sidewall is provided with a protruding thumb tab that extends downwardly beyond the parting line of the lid and the closure body. The thumb tab is received in a complimentary recess in the outer surface of the skirt wall such that the outer surface of the thumb tab and the outer surface of the skirt wall form a substantially continuous outer surface. In use, the lid is selectively movable between a closed position and an open position. Conventional friction fit surface areas (spud and orifice) are employed to maintain the lid in its normally closed position.

The label is preferably a paper label having width configured and arranged to wrap around the periphery of the closure skirt and container neck and a height configured and arranged to overlap the neck of the container and the skirt of the closure. More specifically, the label is adhesively bonded to the neck of the container and the skirt of the closure, just below the parting line of the lid and closure, so that the label overlaps that portion of the thumb tab that extends downward below the parting line of the lid and closure body.

In this regard, when the thumb tab is lifted to open the container, the paper label is ripped in the area of the thumb tab to evidence opening thereof. In preferred embodiments of the invention, parts of the label can be perforated in the area of the thumb tab or in a circumferential line around the skirt to facilitate and emphasize tearing or ripping of the label. In addition, the adhesive can be selectively applied so as to further emphasize tearing and/or ripping of the label. Perforated shrink-wrap is also a possible alternative label material. As noted above, this preferred embodiment is operable with a closure and bottleneck having no required orientation and will work at any position 360 degrees around the bottleneck.

In some cases the product vendors desire an oriented cap that aligns in a particular orientation with regard to the bottle or bottleneck. An alternative embodiment of the invention includes a closure that is threaded for a particular orientation, i.e. typically with the thumb tab aligned with the front of the bottle, and a label that also includes an orientation feature. In this case, the orientation feature is a slot provided in the label for receiving a protruding portion of the thumb tab.

It can thus an object of the present invention to provide a tamper evidence closure and label system wherein a unique thumb tab on closure is operative for tearing an upper edge portion of the label upon opening. The closure and the label arrangement thus provide a system wherein the majority of the label remains substantially intact, but yet provides a clear indication of prior opening directly at the point of application of force to open the container, i.e. the evidence of tampering is clearly visible at the point where the closure is opened.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
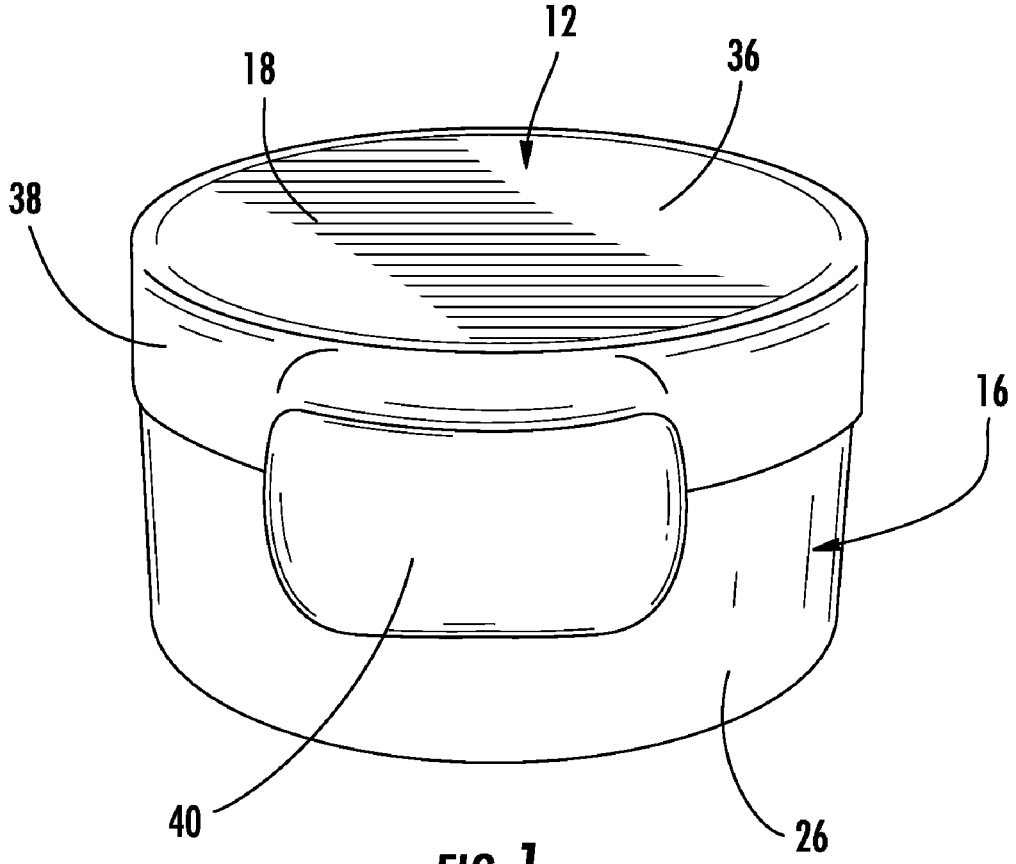
FIG. 1 is a perspective front view of the closure in accordance with the present invention.

Referring now to the drawings, the dispensing closure and label system of the present invention is illustrated and generally indicated at 10 in FIGS. 7-11. As will hereinafter be more fully described, the instant dispensing closure and label system 10 provides a clear indication of prior opening directly at the point of application of force to open the closure.

Generally the system 10 comprises a dispensing closure generally indicated at 12 and a label generally indicated at 14.

The dispensing closure 12 comprises a body 16, a lid 18 and an integrally formed living hinge 20 that joins the lid 18 to the body 16.

The body 16 of the closure 12 includes an upper deck 22 having a central dispensing orifice 24, and further includes a downwardly depending skirt 26 with internal threads 28 (FIG. 7) that are configured and arranged to engage with external threads 30 on the neck 32 of a container 34. The skirt 26 of the closure 12 and the neck 32 of the container 34 are configured to have substantially similar outer dimensions. It is noted that this particular embodiment is designed for a bottleneck having no required orientation and will work at any position 360 degrees around the bottleneck.

Figure 2:
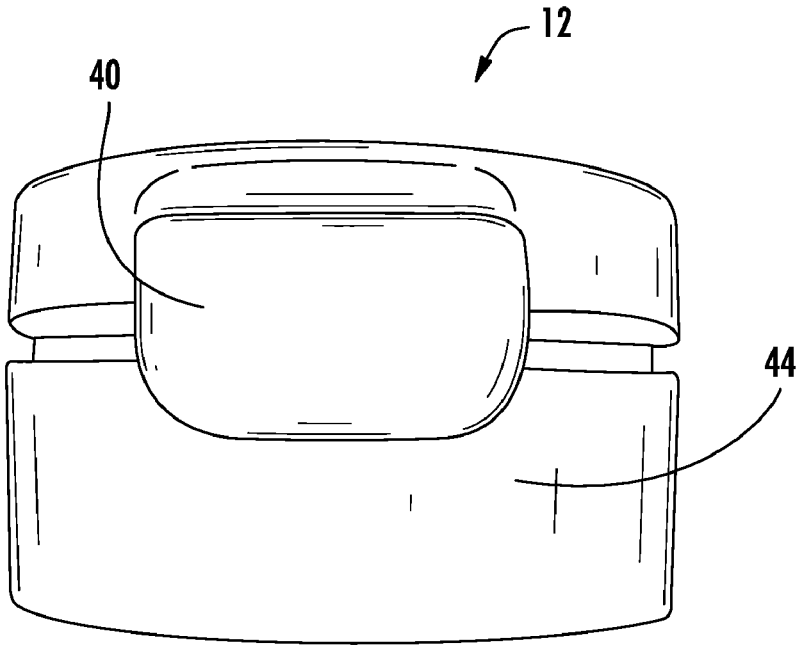
FIG. 2 is another front perspective view thereof showing the lid of the closure partially opened.
Figure 3:
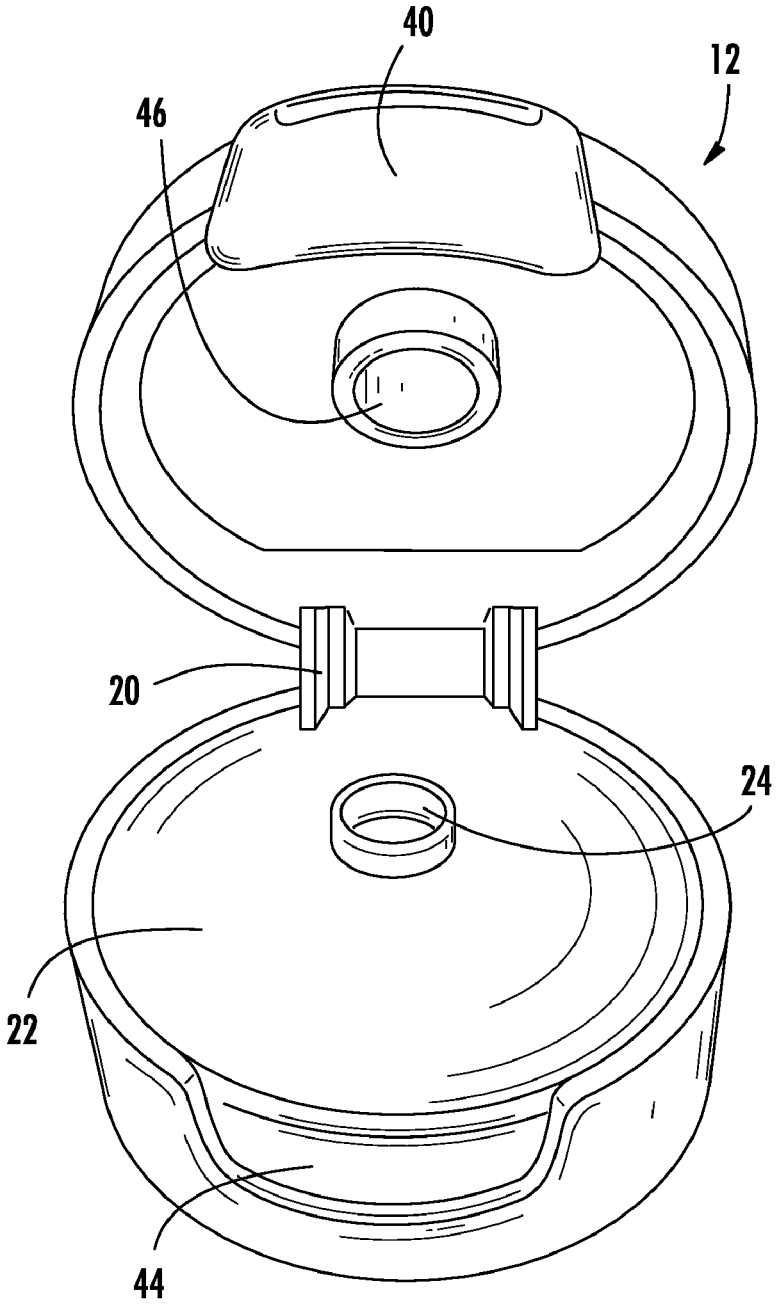
FIG. 3 is a top perspective view thereof showing the lid fully opened.
Figure 4:
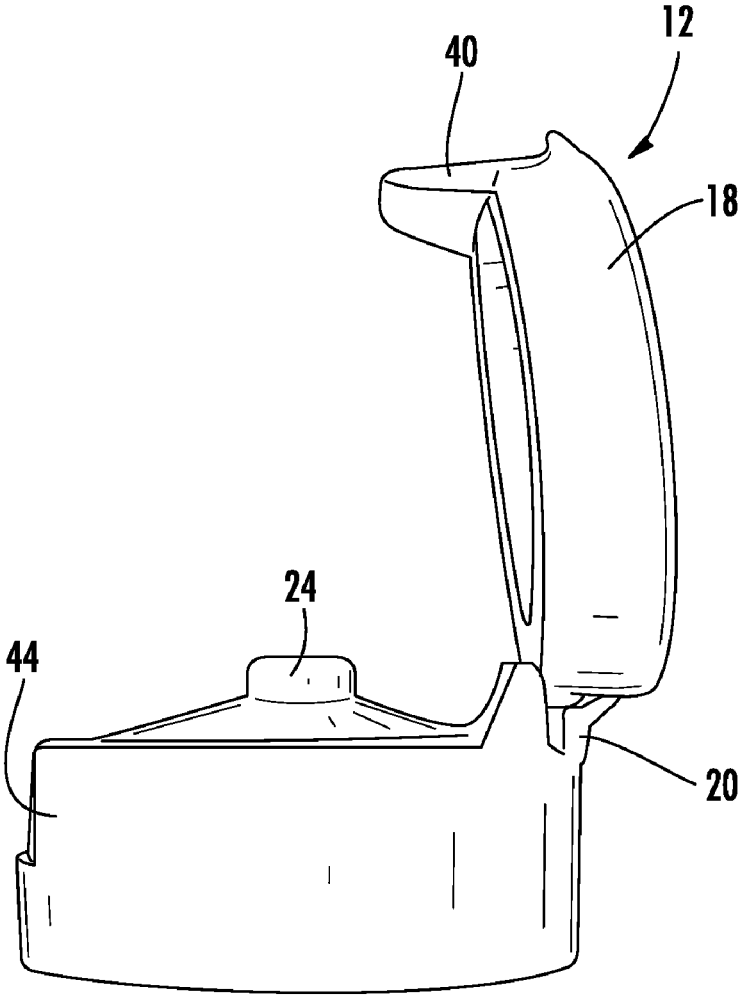
FIG. 4 is a side view thereof.
Figure 5:
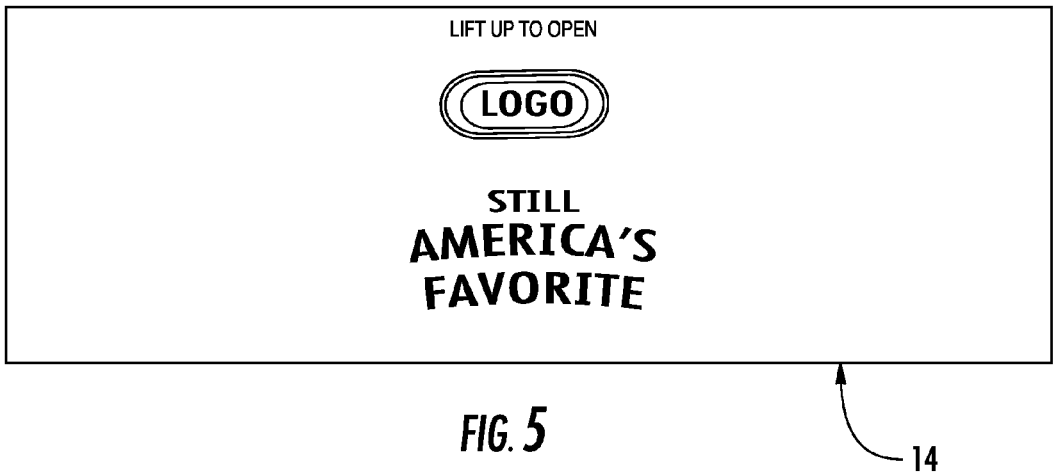
FIG. 5 is a front plan view of the label in accordance with the present invention.

The lid 18 includes a top wall 36 and a downwardly depending sidewall 38. Opposite to the hinge 20, the sidewall 38 is provided with a protruding thumb tab 40 that extends downwardly beyond the parting line 42 of the lid 18 and the closure body 16. The thumb tab 40 is received in overlapping relation in a complimentary recess 44 in the outer surface of the skirt wall 26 such that the outer surface of the thumb tab 40 and the outer surface of the skirt wall 26 form a substantially continuous outer surface. In use, the lid 18 is selectively movable between a closed position (FIG. 1) and an open position (FIGS. 2-4). Conventional friction fit surface features, such as rim 46 and orifice 24, are employed to maintain the lid 18 in its normally closed position.

The label 14 is preferably a paper label having width configured and arranged to wrap around the periphery of the closure skirt 26 and container neck 32 and a height configured and arranged to overlap the neck 32 of the container 34 and the skirt 26 of the closure 12. More specifically, the label 14 is adhesively bonded to the neck 32 of the container 34 and the skirt 26 of the closure 12, just below the parting line 42 of the lid 18 and closure 12, so that the label 14 overlaps that portion of the thumb tab 40 that extends downward below the parting line 42 of the lid 18 and closure body 12. No particular orientation of the label or the closure with regard to the bottleneck is required for proper operation of the system 10.

Figure 10:
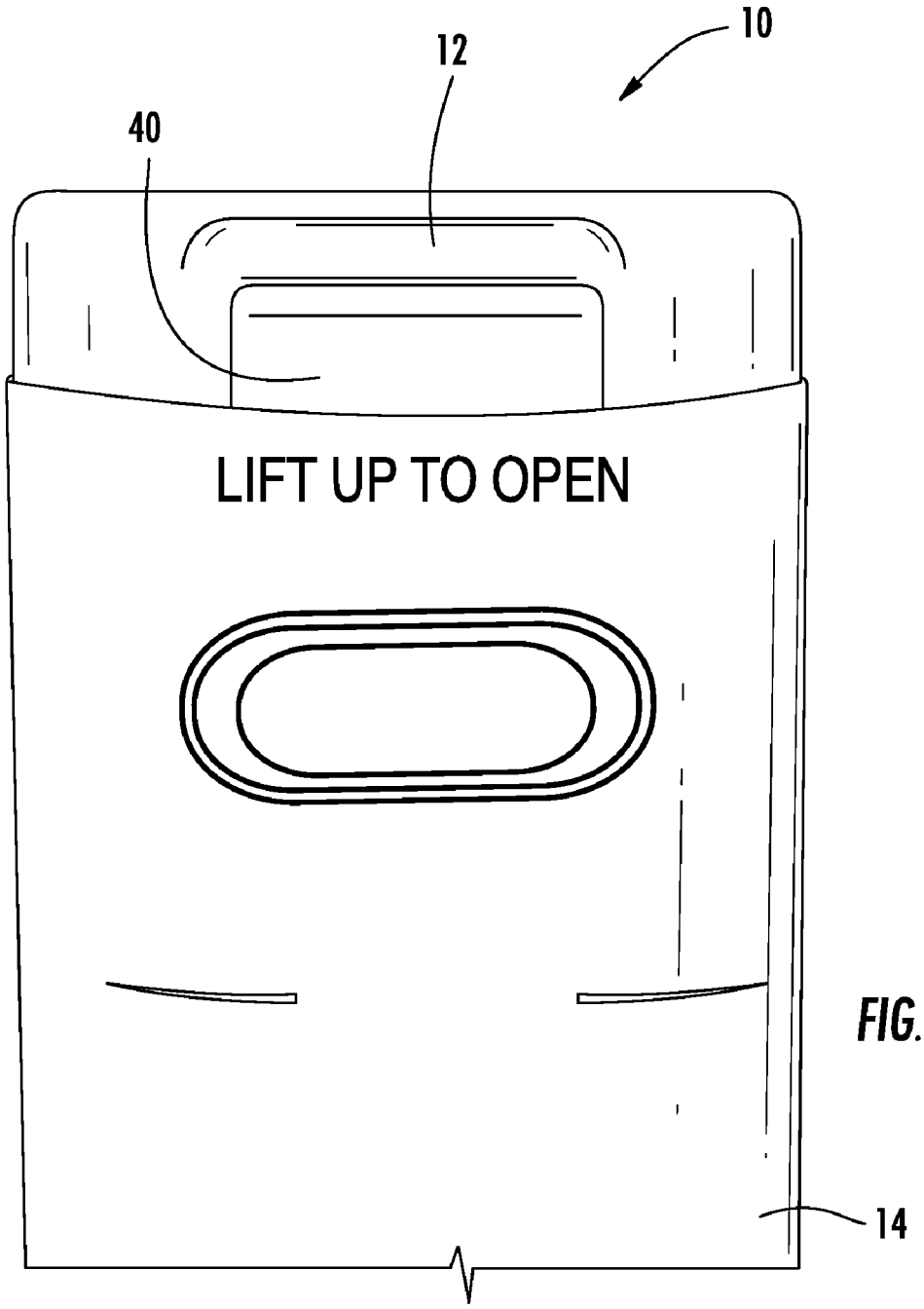
FIG. 10 is a front view of the dispensing closure and label with the lid in a normally closed position for initial sale of the product.
Figure 11:
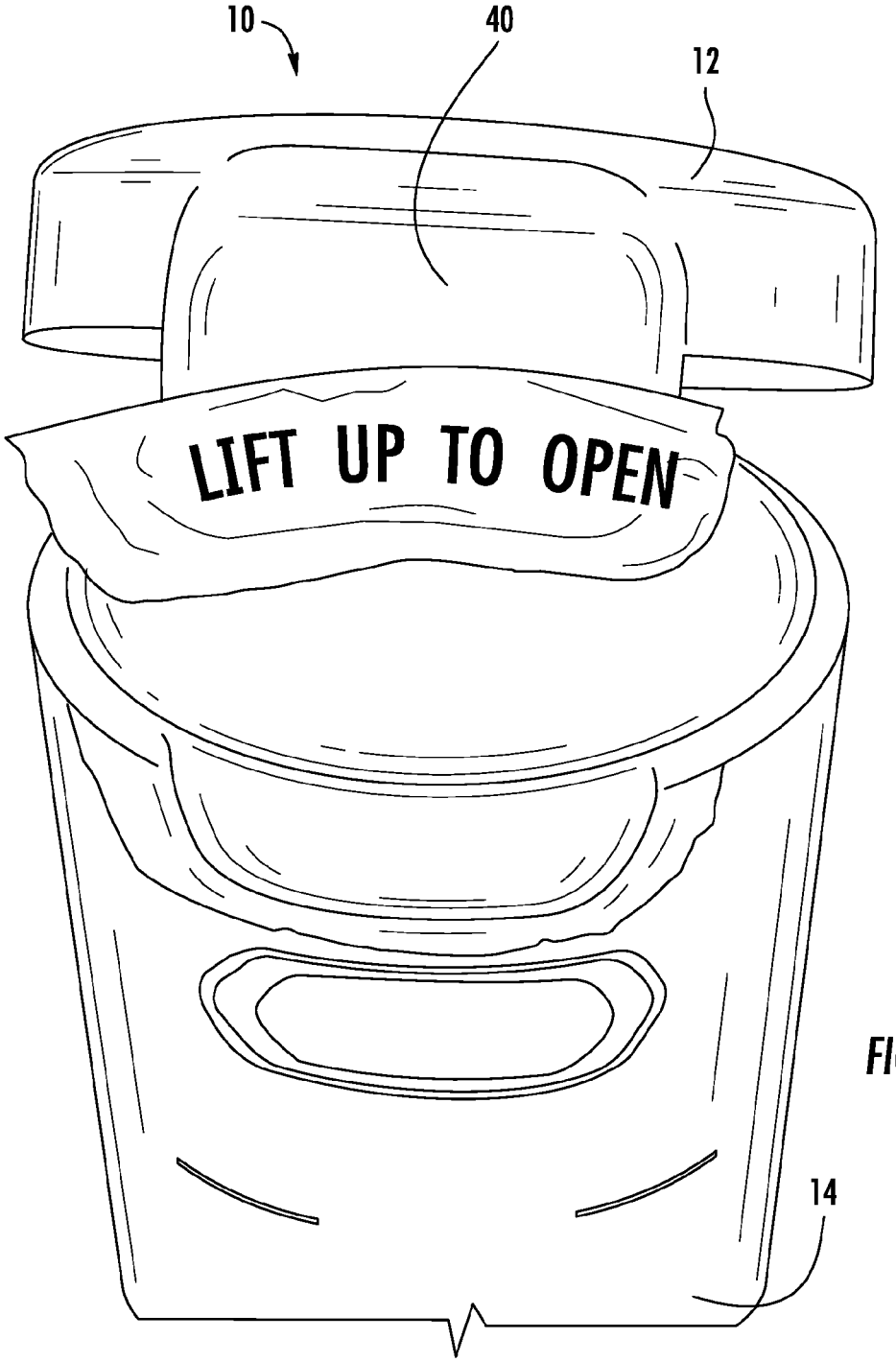
FIG. 11 is a front view thereof showing the lid opened and the label torn to evidence opening thereof.

In this regard, when the thumb tab 40 is lifted to open the closure 12, the paper label 14 is ripped in the area of the thumb tab 40 to evidence opening thereof (See FIGS. 10-11).

In preferred embodiments of the invention, parts of the label 14 can be perforated in the area of the thumb tab 40 or in a circumferential line around the entire skirt to facilitate and emphasize tearing or ripping of the label 14. In addition, the adhesive can be selectively applied so as to further emphasize tearing and/or ripping of the label 14.

As an alternative to paper labels, perforated shrink wrap would also provide the same or similar results.

Figure 6:
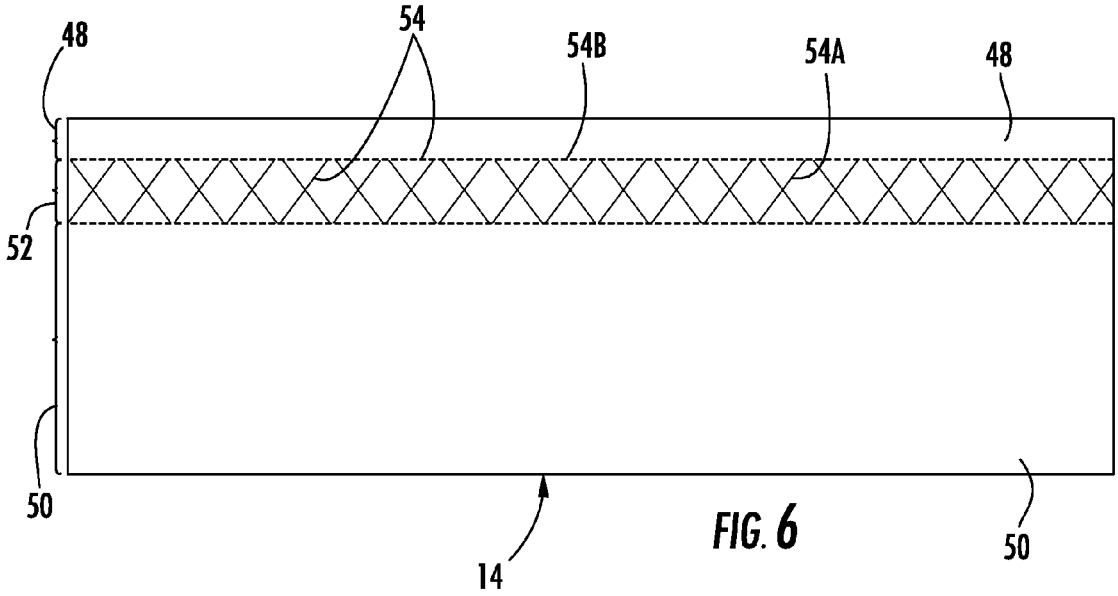
FIG. 6 is a rear plan view thereof showing the preferred perforation and gluing configurations.
Figure 7:
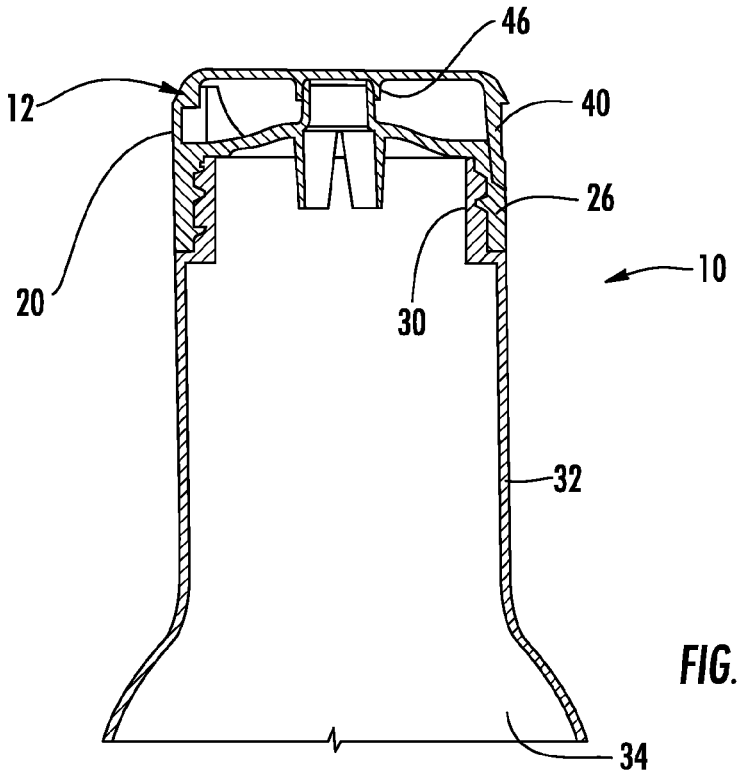
FIG. 7 is a cross-sectional view of the dispensing closure mounted onto the neck of a complimentary container.
Figure 8:
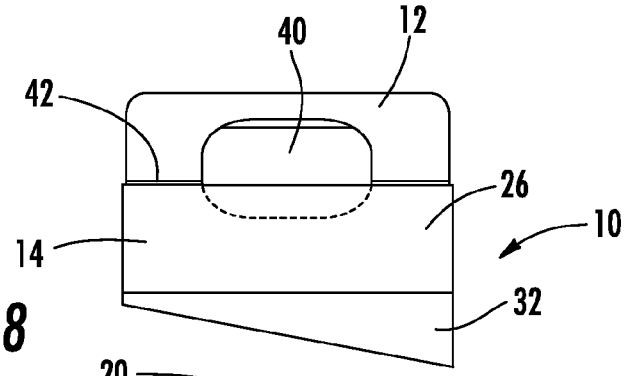
FIG. 8 is a front view of the closure body, illustrating placement of the label relative to the neck of the container, the skirt of the closure, and the parting line of the lid and body.
Figure 9:
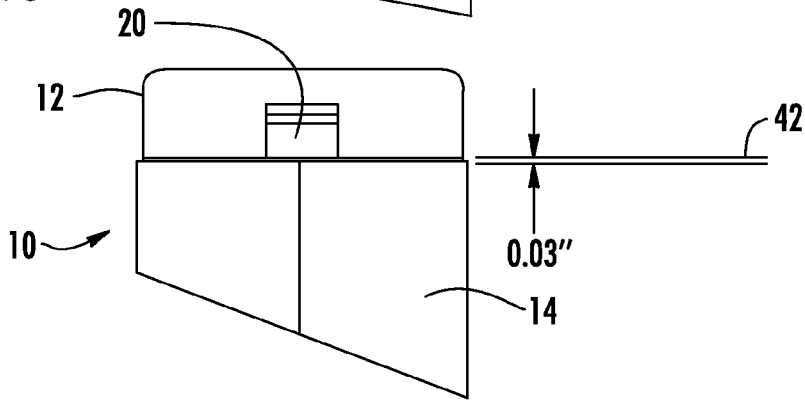
FIG. 9 is a rear view thereof.

Referring to FIG. 6, a preferred arrangement of the label 14 is illustrated. The label 14 has an upper peripheral edge portion 48 that is glued to the skirt 26 of the closure 12 and a lower peripheral edge portion 50 that is glued to the neck 32 of the container 34. The label 14 further includes a central portion 52 that is perforated with a series of scored lines 54. The size spacing and angular arrangement of the perforations 54 is not entirely critical. However, the current preferred arrangement includes a plurality of spaced and angled score lines 54*a* forming a series of cross-hatched score lines. In addition, the upper terminal edge of the central portion further includes a series of linear score lines 54*b* approximately 5/16 inch long and spaced by about 1/8 inch. It is also an important feature that the central scored portion 52 of the label 14 is not glued to the closure. It has been found through experimentation that the unglued central portion 52 more readily tears and creates a more jagged torn edge that if the central portion 52 were entirely glued to the closure. In addition, it has also been found that the unglued area is even more effective if it extends partially down into the lower portion of the label 14, below the edge of scored area.

Again it is noted that the illustrated size and spacing of the score lines and the adhesive pattern are not entirely critical to the invention. There are likely to be many different configurations that provide suitable tearing of the label 14. However, the preferred arrangement appears to provide a highly visible and demonstrative tear in the label that cannot be overlooked once the container is opened.

Figure 12:
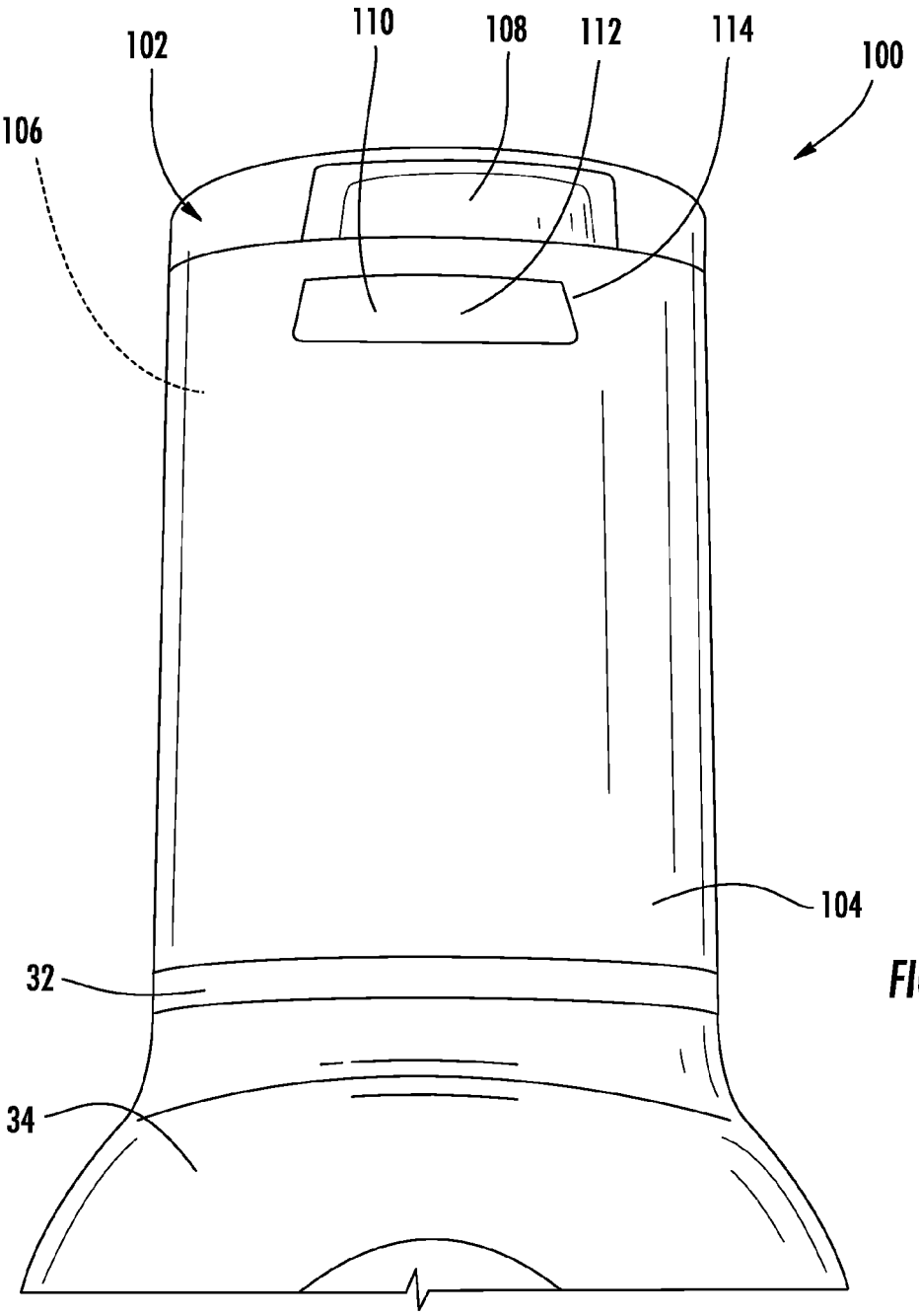
FIG. 12 is a front view of an alternative embodiment wherein the closure and label are oriented with regard to the bottleneck.

As noted above, this preferred embodiment is operable with a closure 12 and bottleneck 32 having no required orientation and will work at any position 360 degrees around the bottleneck. However, in some cases the product vendors desire an oriented closure that aligns in a particular orientation with regard to the bottle or bottleneck 32. Turning to FIG. 12, an alternative embodiment of the invention is illustrated and generally indicated at 100. The alternative system 100 includes a closure 102 and a label 104. The closure 102 comprises a body 106 (hidden behind label), a lid 108 and an integrally formed living hinge (not shown) that joins the lid 108 to the body. The closure is generally similar to the previously described closure 12 with two notable exceptions. The first is that the thumb tab 110 includes a radially outwardly extending protrusion 112. The second is that the inner wall (not shown) of the skirt of the closure body is threaded for a particular orientation, i.e. typically with the thumb tab 110 aligned with the flat front of the bottle. The label 104 is also substantially similar to the label described hereinabove, but also includes an orientation feature. In this case, the orientation feature is a slot 114 configured and arranged to receive the protruding portion 112 of the thumb tab 110. Both the protruding thumb portion 112 and the slot 114 provide for a predetermined rotational orientation.

Figure 13:
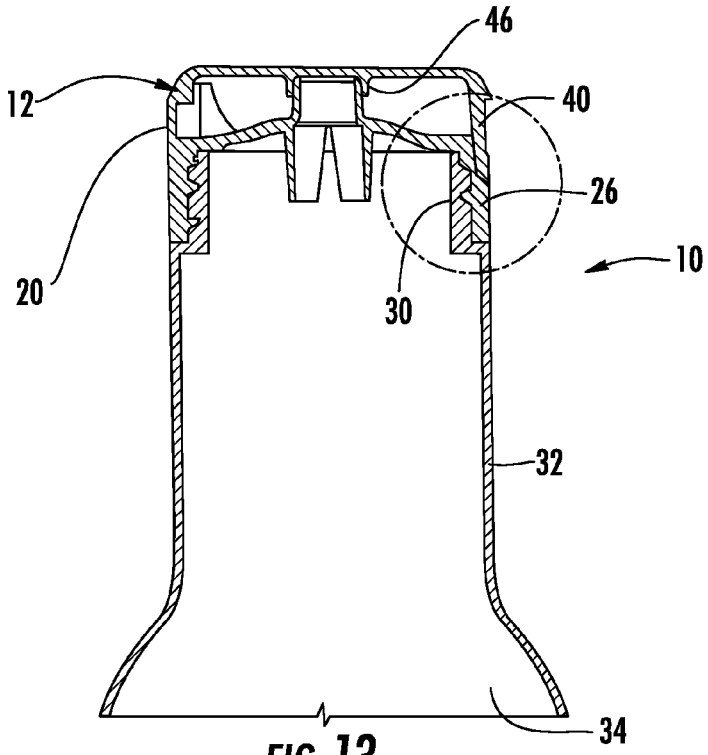
FIGS. 13 and 13A are cross-sectional views of an alternate thumb tab configuration.
Figure 13A:
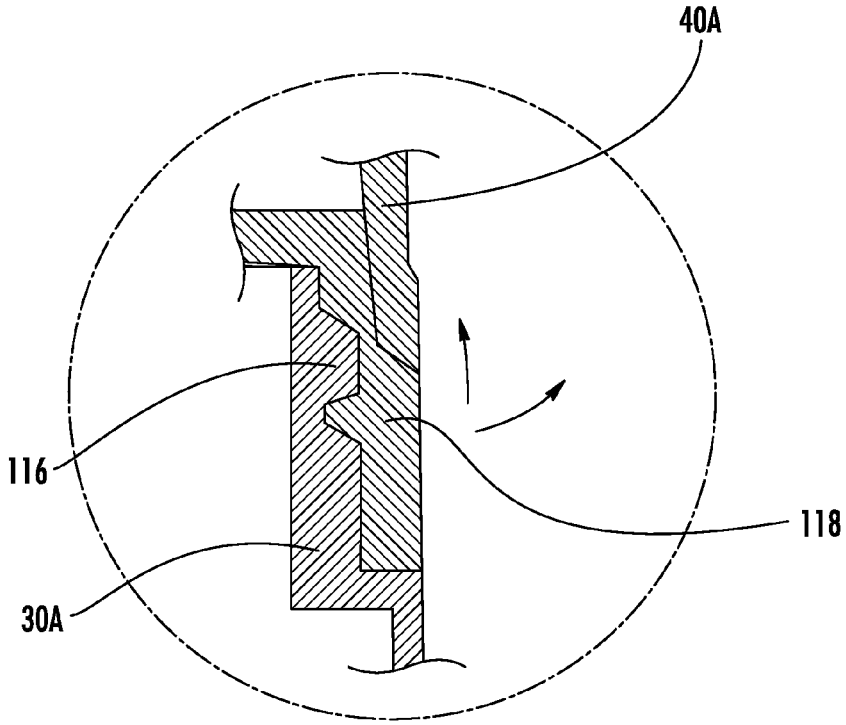
Figure 14:
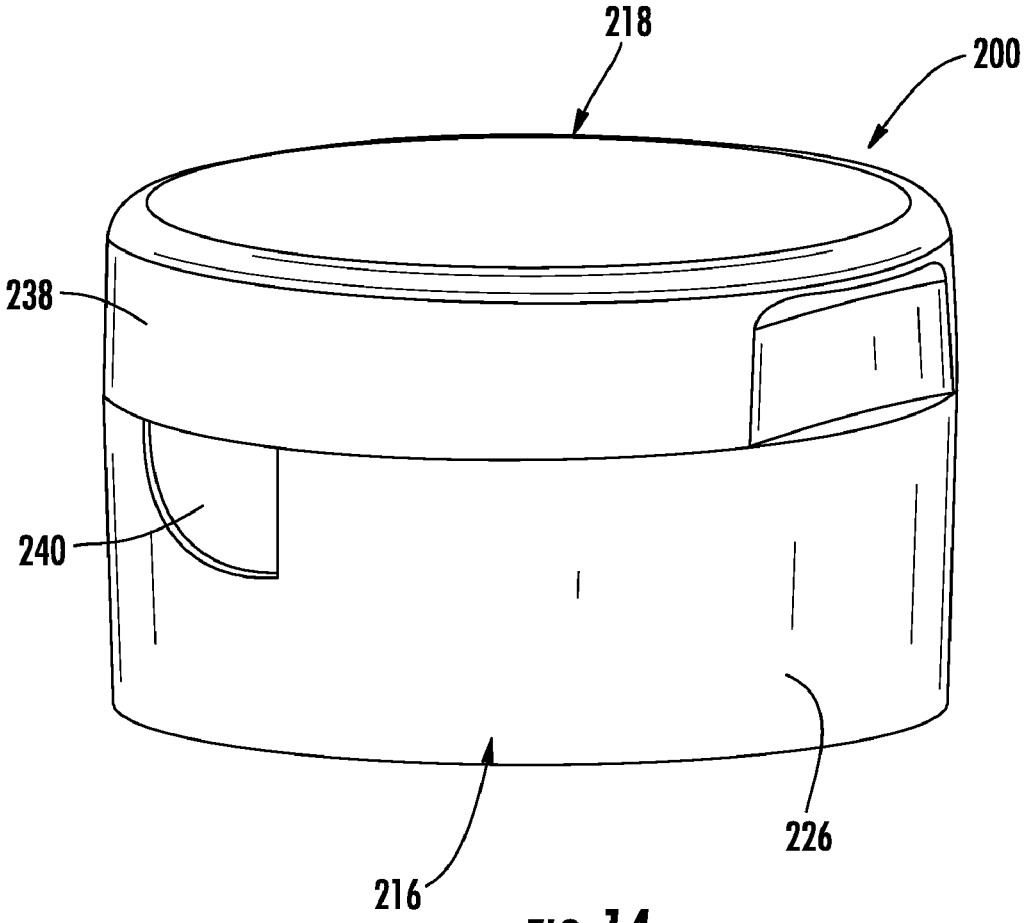
FIG. 14 is a perspective view of an alternate embodiment of the closure.

Turning to FIGS. 13-17, the dispensing closure 12A may optionally be provided with an interference structure, which will naturally force the outside face of the tab 40 outwardly from the normal planar surface of the sidewall 38 of the lid 18 to facilitate breaking of the label 14 during opening of the closure. FIG. 13 illustrates such a structure in the context of the closure 12 as illustrated in FIGS. 1-12. In this regard, the outer surface of the recess 44*a* is molded to include a small rounded shoulder 116, while the inner surface of the thumb tab 40*a* is molded to include a complementary recess 118. When received in assembled relation, the shoulder 116 and recess 118 interfit and the thumb tab 40*a* remains in its normal un-displaced position. However, as the thumb tab 40*a* is actuated upwardly, the shoulder 116 interferes with movement of the tab, and forces the tab 40*a* outwardly to allow room to move over the shoulder 116. Outward movement of the tab 40*a* facilitates ripping of the label 14.

Figure 15:
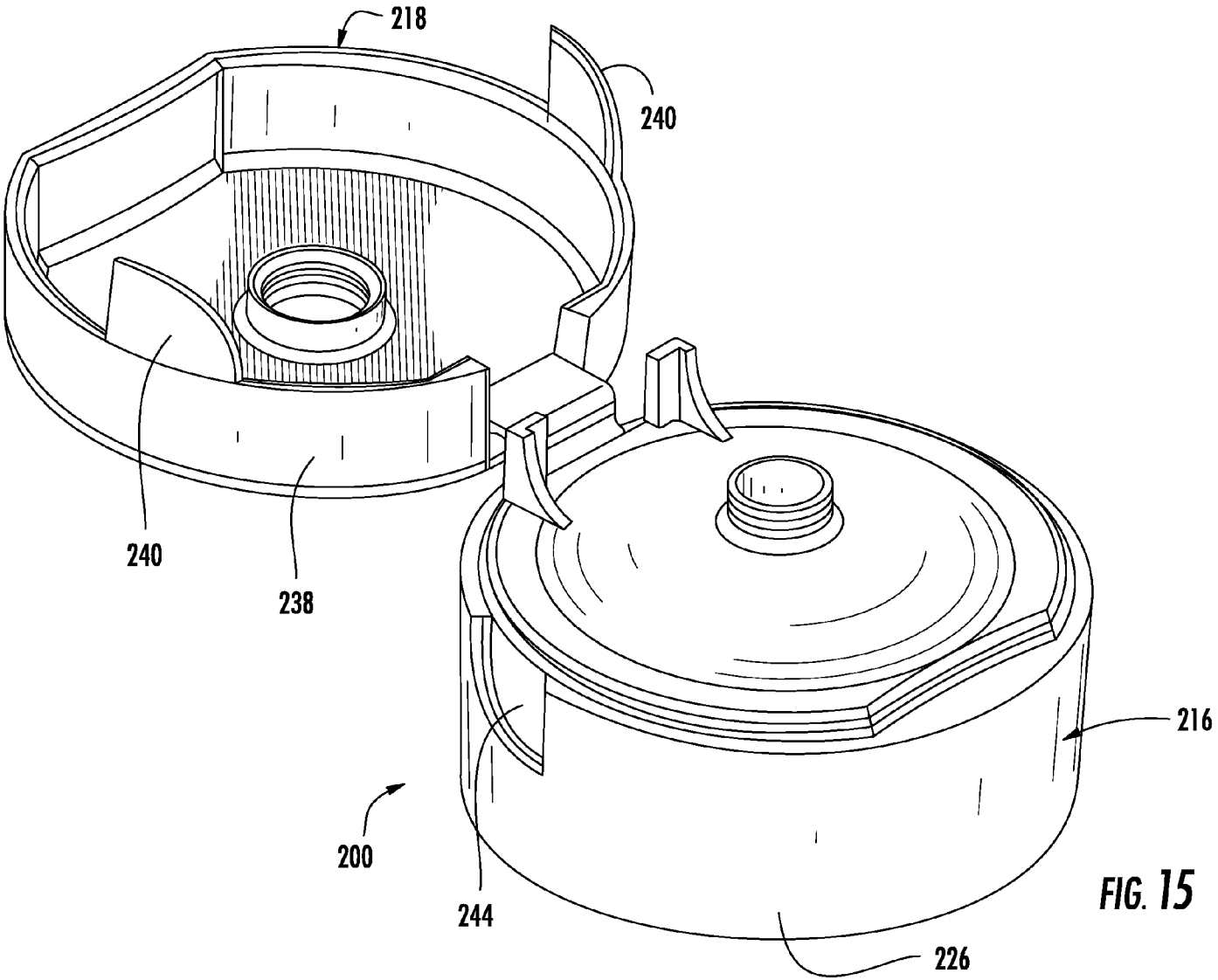
FIGS. 15-17 are additional perspective views thereof showing the cap in the open position.
Figure 16:
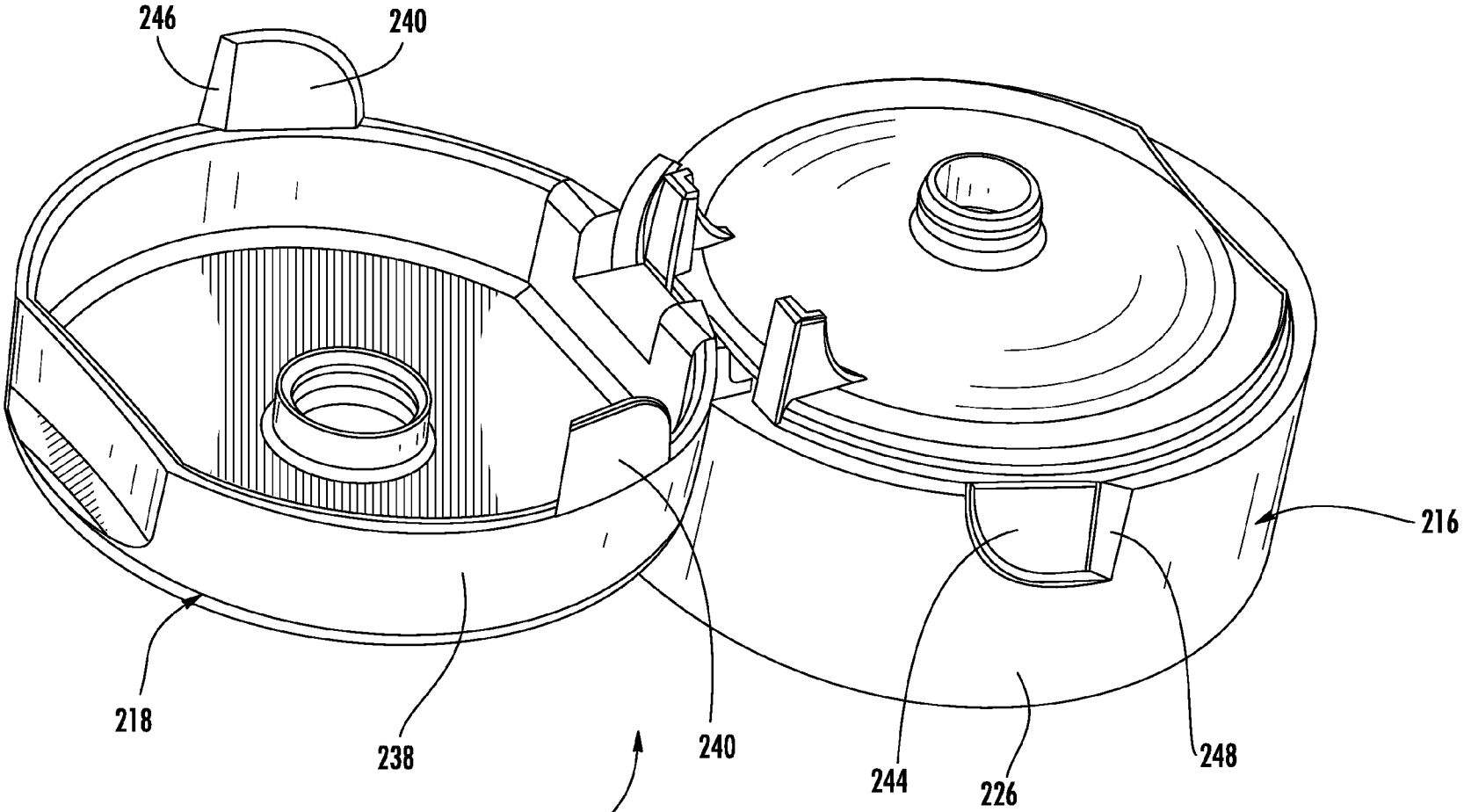
Figure 17:
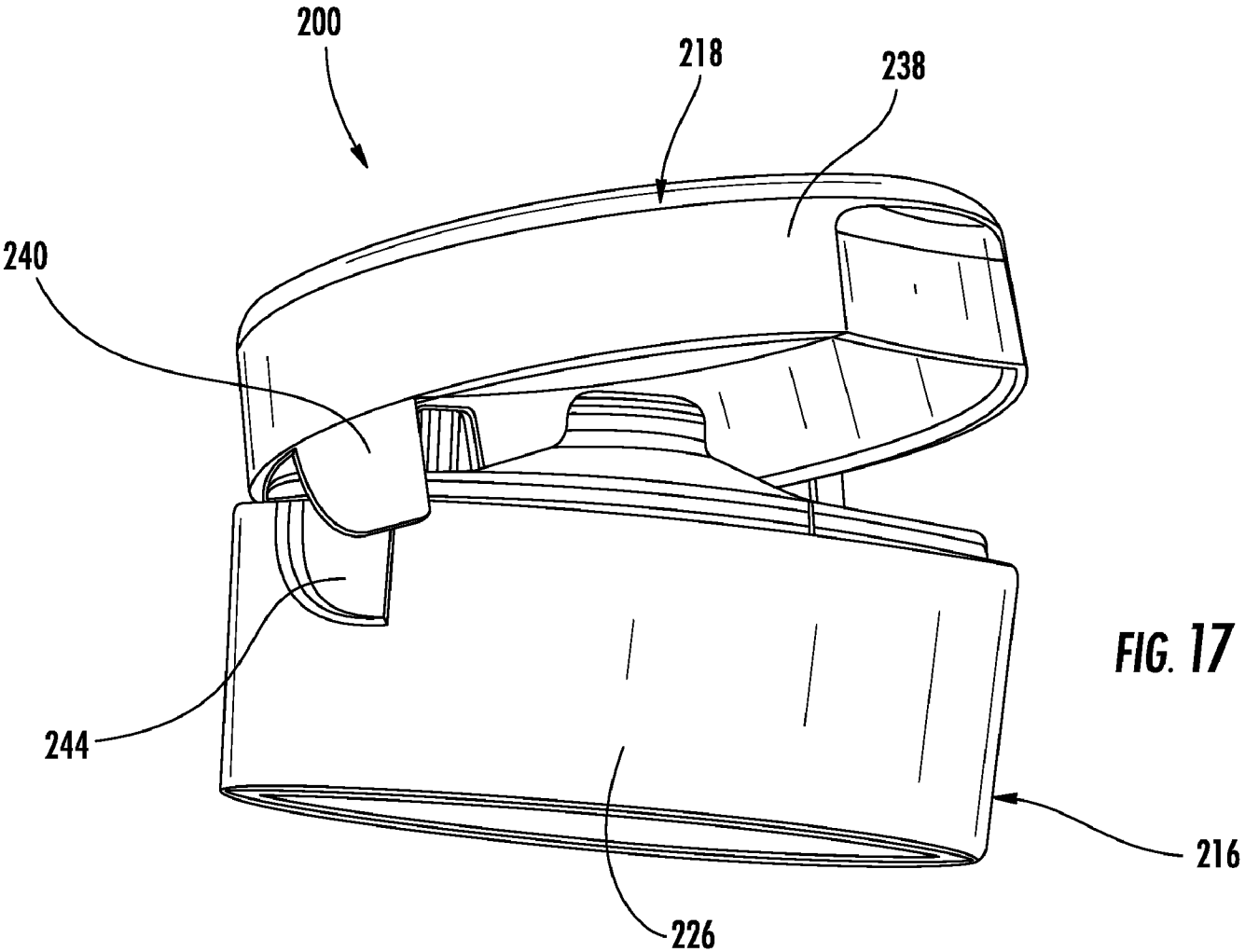

Referring now to FIGS. 14-17, an alternative embodiment of the closure is illustrated and generally indicated at 200. The closure 200 is generally of the same construction and operation, and includes a body portion 216, and a lid 218. However, the thumb tab 40 as illustrated in the earlier embodiment 12 is replaced by a pair of wing tabs 240 formed on the opposing sides of the lid sidewall 238. These wing tabs 240 extend below the parting line 240 of the lid 218 and the body 216. The wing tabs 240 are received in overlapping relation in complementary recesses 244 in the outer surface of the skirt wall 226 forming a continuous outer surface. The lid 218 is selectively movable between a closed position (FIG. 14) and an open position (FIGS. 15-17). The use of the wing tabs 240 is advantageous in that the wing tabs 240 and recesses 244 can be provided with angled cam surfaces 246, 248 that naturally force the wing tabs 240 outwardly when the lid 216 is actuated openly. More specifically, as the lid 216 is moved open, the cam surfaces 248 on the wing tabs 240 ride up and over the cam surfaces 248 in the recesses and are moved out of the surface plane of the body skirt 226 (FIG. 17). As described above, the outward movement of the tabs 240 facilitates tearing of the label 14.

It can thus be seen that the present arrangement of the thumb tab 40 and/or wing tabs 240 and the label 14 provide a system wherein the majority of the label remains substantially intact, but yet provides a clear indication of prior opening directly at the point of application of force to open the container, i.e. the evidence of tampering is clearly visible at the point where the closure is opened. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A tamper evident dispensing closure and label system and container comprising:

a container including a dispensing neck;

a dispensing closure; and a label, said dispensing closure comprising a body, a lid and an integrally formed living hinge that joins the lid to the body, said body of said closure including an upper deck having a central dispensing orifice, and further including a downwardly depending skirt having internal threads configured and arranged to engage with external threads on a dispensing neck of a container, said skirt further having a substantially smooth outer surface, said lid including a top wall and a downwardly depending side wall, said side wall including a protruding tab having a substantially smooth outer surface, said tab extending downwardly beyond a parting line defined between said lid and said closure body, said label being secured around said dispensing neck of said container and said skirt just below said parting line so that said label overlaps a portion of said tab that extends downward below said parting line, said label having a width configured and arranged to wrap around a periphery of said skirt and said dispensing neck and a height configured and arranged to overlap said dispensing neck and said skirt, said tab having a shape, said tab being received in overlapping relation in a recess in an outer surface of said skirt, said recess having a shape that is complementary to said shape of said tab such that said substantially smooth outer surface of said tab and said substantially smooth outer surface of said skirt cooperate to form a substantially continuous, substantially smooth outer surface beneath said label, said lid including a lifting structure on said side wall above said tab, whereby said label is ripped in the area of said tab to evidence opening thereof when said lid is opened.

2. The system of claim 1 wherein said label is selectively perforated in predetermined areas to facilitate tearing of the label.

3. The system of claim 1 wherein an adhesive is selectively applied so as to further emphasize tearing and/or ripping of the label.

4. The system of claim 1 wherein the dispensing closure and label include orientation features.

5. The system of claim 1 wherein said tab includes means for moving the tab outwardly relative to the body skirt to facilitate tearing of the label.

* * * * *